US010507354B2

(12) United States Patent
Kiani

(10) Patent No.: US 10,507,354 B2
(45) Date of Patent: Dec. 17, 2019

(54) EXERCISE APPARATUS WITH OSCILLATING TILT SYSTEM

(71) Applicant: Ali Kiani, Coquitlam (CA)

(72) Inventor: Ali Kiani, Coquitlam (CA)

(73) Assignee: Ali Kiani, Vancouver (CA)

( * ) Notice: Subject to any disclaimer, the term of this patent is extended or adjusted under 35 U.S.C. 154(b) by 0 days.

(21) Appl. No.: 16/177,359

(22) Filed: Oct. 31, 2018

(65) Prior Publication Data

US 2019/0070453 A1 Mar. 7, 2019

Related U.S. Application Data

(60) Provisional application No. 62/623,340, filed on Jan. 29, 2018.

(51) Int. Cl.
*A63B 22/00* (2006.01)
*A63B 71/06* (2006.01)
(Continued)

(52) U.S. Cl.
CPC .... *A63B 22/0023* (2013.01); *A63B 21/00192* (2013.01); *A63B 21/012* (2013.01); *A63B 21/068* (2013.01); *A63B 21/0622* (2015.10); *A63B 21/151* (2013.01); *A63B 21/154* (2013.01); *A63B 21/4045* (2015.10); *A63B 21/4049* (2015.10); *A63B 22/001* (2013.01); *A63B 22/0005* (2015.10); *A63B 22/0025* (2015.10); *A63B 22/0605* (2013.01); *A63B 22/0694* (2013.01); *A63B 22/208* (2013.01); *A63B 23/03575* (2013.01);
(Continued)

(58) Field of Classification Search
CPC ..... A63B 22/0023; A63B 21/0622; A63B 22/208; A63B 21/151; A63B 22/0005; A63B 21/068; A63B 24/0087; A63B 24/0062; A63B 23/03575; A63B 22/0694; A63B 21/154; A63B 21/012; A63B 21/00192; A63B 22/0025; A63B 21/4049; A63B 21/4045; A63B 21/4035; A63B 21/4034; A63B 22/0605; A63B 22/001; A63B 71/0622; A63B 21/00069; A63B 21/005; A63B 21/159; A63B 2022/0611; A63B 69/0057; A63B 2022/0647; A63B 71/023; A63B 2225/093; A63B 2220/833; A63B 2022/0043; A63B 2230/75; A63B 2230/06
See application file for complete search history.

(56) References Cited

U.S. PATENT DOCUMENTS 4,958,830 A * 9/1990 Huggins ..... A61H 1/0259 482/51
5,000,441 A * 3/1991 Wang ..... A63B 22/0002 482/112
(Continued)

*Primary Examiner* — Sundhara M Ganesan

(57) ABSTRACT

An exercise apparatus with oscillating tilt system includes a main frame for supporting all the components of the apparatus, a tiltable upstanding support is tilted oscillating, a mechanism which enabling a user of the apparatus to move hands and feet up and down harmoniously, and another mechanism to change an orientation of the user in relation to the vertical line oscillating during the exercise, and consequently changing the direction of the forces affecting different muscles of the user of the apparatus.

7 Claims, 12 Drawing Sheets

(51) Int. Cl.

| | |
|---|---|
| ***A63B 22/06*** | (2006.01) |
| ***A63B 21/068*** | (2006.01) |
| ***A63B 21/00*** | (2006.01) |
| ***A63B 22/20*** | (2006.01) |
| ***A63B 21/062*** | (2006.01) |
| ***A63B 21/012*** | (2006.01) |
| ***A63B 23/035*** | (2006.01) |
| ***A63B 24/00*** | (2006.01) |
| ***A63B 71/02*** | (2006.01) |
| ***A63B 69/00*** | (2006.01) |
| ***A63B 21/005*** | (2006.01) |

(52) U.S. Cl.

CPC ..... *A63B 24/0062* (2013.01); *A63B 24/0087* (2013.01); *A63B 71/0622* (2013.01); *A63B 21/005* (2013.01); *A63B 21/00069* (2013.01); *A63B 21/159* (2013.01); *A63B 69/0057* (2013.01); *A63B 71/023* (2013.01); *A63B 2022/0043* (2013.01); *A63B 2022/0611* (2013.01); *A63B 2022/0647* (2013.01); *A63B 2220/833* (2013.01); *A63B 2225/093* (2013.01); *A63B 2230/06* (2013.01); *A63B 2230/75* (2013.01)

(56) References Cited

U.S. PATENT DOCUMENTS

| | | | | | |
|---|---|---|---|---|---|
| 5,007,631 | A * | 4/1991 | Wang | A63B 22/001 | 482/119 |
| 5,040,785 | A * | 8/1991 | Charnitski | A63B 22/001 | 482/51 |
| 5,090,690 | A * | 2/1992 | Huang | A63B 22/0002 | 482/131 |
| 5,145,475 | A * | 9/1992 | Cares | A63B 21/157 | 482/52 |
| 5,492,515 | A * | 2/1996 | Charnitski | A63B 22/001 | 482/37 |
| 5,679,100 | A * | 10/1997 | Charnitski | A63B 22/001 | 482/37 |
| 6,648,802 | B2 | 11/2003 | Ware | | |
| 8,540,609 | B2 * | 9/2013 | Anderson | A63B 21/154 | 482/52 |
| 9,044,630 | B1 | 6/2015 | Lampert et al. | | |
| 10,046,196 | B2 * | 8/2018 | Ercanbrack | A63B 22/0664 | |
| 2002/0128121 | A1 * | 9/2002 | Welch | A63B 21/00 | 482/51 |
| 2007/0219065 | A1 * | 9/2007 | Anderson | A63B 21/154 | 482/52 |
| 2014/0248998 | A1 * | 9/2014 | Lu | A63B 21/154 | 482/52 |
| 2016/0346599 | A1 | 12/2016 | Dalebout et al. | | |
| 2017/0056717 | A1 | 3/2017 | Ercanbrack et al. | | |

* cited by examiner

EXERCISE APPARATUS WITH OSCILLATING TILT SYSTEM

1. FIELD OF THE INVENTION

The invention relates to the field of exercise equipment and in particular a motion-based mechanism to be used to change user's body orientation and consequently changing the forces affecting on different muscles of the user.

2. BACKGROUND

Maintaining proper fitness is a growing concern for many people. Medical community has become increasingly aware of the value of exercise to the overall health of an individual. Furthermore, athletes need regular and stringent workout to maintain their abilities. Exercise apparatuses have been, and still are, an important part of the sport and workout. Exercise apparatuses have evolved from simple equipment to advanced and technically sophisticated equipment with special mechanisms. Using mechanical and electrical parts and new software enables users to take more advantages of exercise apparatuses.

In conventional exercise machine usually the user's body orientation does not change notably and continuously, if user wants a harder workout then the user increases the resistance of the running platform and thereby increasing the forces affecting the same muscles. The problem with this type of resistance in the exercise machine is that there is a limited range and direction of resistance for increasing the strength of the users. Changing the orientation of the user will change effects and directions of the resisting forces and this helps user to have a better workout.

3. DESCRIPTION

The described exercise apparatus enabling a user of the apparatus to move hands and feet up and down harmoniously, and providing an oscillating tilt on the tiltable upstanding support of the apparatus while the user is getting exercise, this changes the user's body orientation in relation to the vertical line, thus enabling user to do exercises in a wide range of different orientations.

SUMMARY OF THE INVENTION

Therefore, the object of the present invention is to provide an exercise apparatus with an oscillating tilt system enabling a user to move feet and hands up and down harmoniously, and changing an orientation of said user in relation to a vertical line and consequently changing the effects and direction of the forces affecting different muscles.

According to this invention an exercise apparatus with oscillating tilt system comprises a main frame, a tiltable upstanding support, a pedaling unit, a crank-slider mechanism, a power transmission system, a synchronizer, a tilt mechanism, slide unit, at least one gas spring, a controlling means for adjusting resisting force and a computerized panel for the purpose of showing the parameters such as heart rate, calories burned and speed of said user.

The described exercise apparatus having a plurality of components comprising:

a main frame including a base support adapted to be mounted on a supporting surface, and at least two pivot stands at a front end, at least one pivot stand at a rear end, and at least two pivot stands at a middle section;

a pedaling unit enabling said user pedaling action, said pedaling unit including a main shaft rotatably connected to at least one pivot stand of said at least two pivot stands at the middle section of said main frame, said main shaft having two ends, and two crank arms, each crank arm having a rear end fixed at each end of said main shaft, and having a pedal pivotally connected to a front end of each said crank arm;

an upstanding support having a top end, a bottom end and a middle section, said middle section of said upstanding support pivotally connected to said main shaft of the pedaling unit changing said orientation of said user in relation to the vertical line during a workout;

a crank-slider mechanism positioned at the top end of said upstanding support enabling said hands of said user to move up and down;

a tilt mechanism tilting said upstanding support and changing said orientation of said user in relation to the vertical line;

a power transmission system to transfer power produced by the user from said pedaling unit to said tilt mechanism, said power transmission system reduces angular velocity and consequently increases torque so that said power produced by the user enabling said tilt mechanism tilting said upstanding support;

a synchronizer exchanging power produced by the user between said pedaling unit and said crank-slider mechanism effecting harmonious motion between said feet and hands of said user;

a gas spring comprising a front end pivotally connected to the bottom end of said upstanding support and having a rear end pivotally connected to said at least one pivot stand at the rear end of said main frame to balance forces affecting said upstanding support in changing said orientation of said user in relation to the vertical line;

a controlling means for adjusting a resisting force, wherein adjusting said resisting forces effect of the workout of said user; and a computerized device showing parameters such as heart rate and burned calories of the user.

The crank-slider mechanism further includes a slide unit positioned at the top end of the upstanding support, two crank links, each crank link including a rear end and a front end, each said crank link rear end rotatably connected to the middle section of said upstanding support, and two linkage arms, each linkage arm including a rear end and a front end, each said rear end of said linkage arm pivotally connected to said front end of each respective said crank link and having each said front end of each said linkage arm pivotally connected to the slide unit.

The slide unit further includes two rails fixed laterally at the top end of said upstanding support, and two sliders, each slider having a bottom and a top, each said bottom of said slider slidably connected to each said rail, and each said slider having said top pivotally connected to the front ends of each respective said linkage arm.

The tilt mechanism further includes two tilt mechanism crank arms, each said tilt mechanism crank arm having a rear end and a front end, each said rear end of each said tilt mechanism crank arm rotatably connected to each said at least two pivot stands at the front of said main frame, and at least one tilt mechanism linkage arm, said at least one tilt mechanism linkage arm including a rear end and a front end, said rear end of said at least one tilt mechanism linkage arm pivotally connected to said front end of said tilt mechanism crank arms and said front end of said at least one tilt mechanism linkage arm pivotally connected to the middle section of said upstanding support.

Furthermore, wherein the tilt mechanism is outfitted with electrical power instead of relying on said transferred power produced by said user and an electrical motor gearbox or linear actuator can be used for the purpose of tilting said upstanding support and changing the orientation of the user in relation to the vertical line.

BRIEF DESCRIPTION OF DRAWINGS

Other features and advantages of described invention will become apparent in the following detailed description of preferred embodiments with reference to the appended drawings, of which:

FIG. 10 shows maximum tilt angle of upstanding support with negative angle in relation to the vertical line, and also shows connection point of the upstanding support to the main shaft of the pedaling unit.

DETAILED DESCRIPTION OF EMBODIMENT

The description which follows and the embodiments described therein are provided by way of illustration of an example of particular embodiment of principles of present invention. This example is provided for the purposes of explanation and not limitation of those principles and of the invention.

Figure 1:
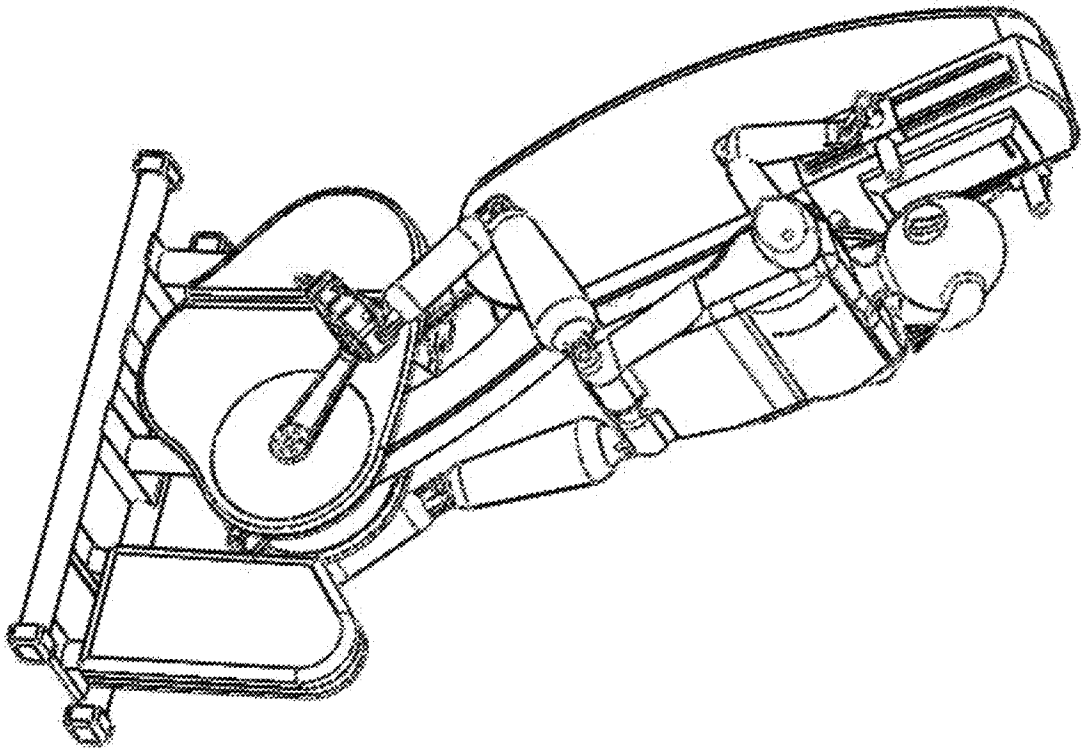
FIG. 1 is a perspective view of described exercise apparatus including all parts, cases and shows position of the user.
Figure 2:
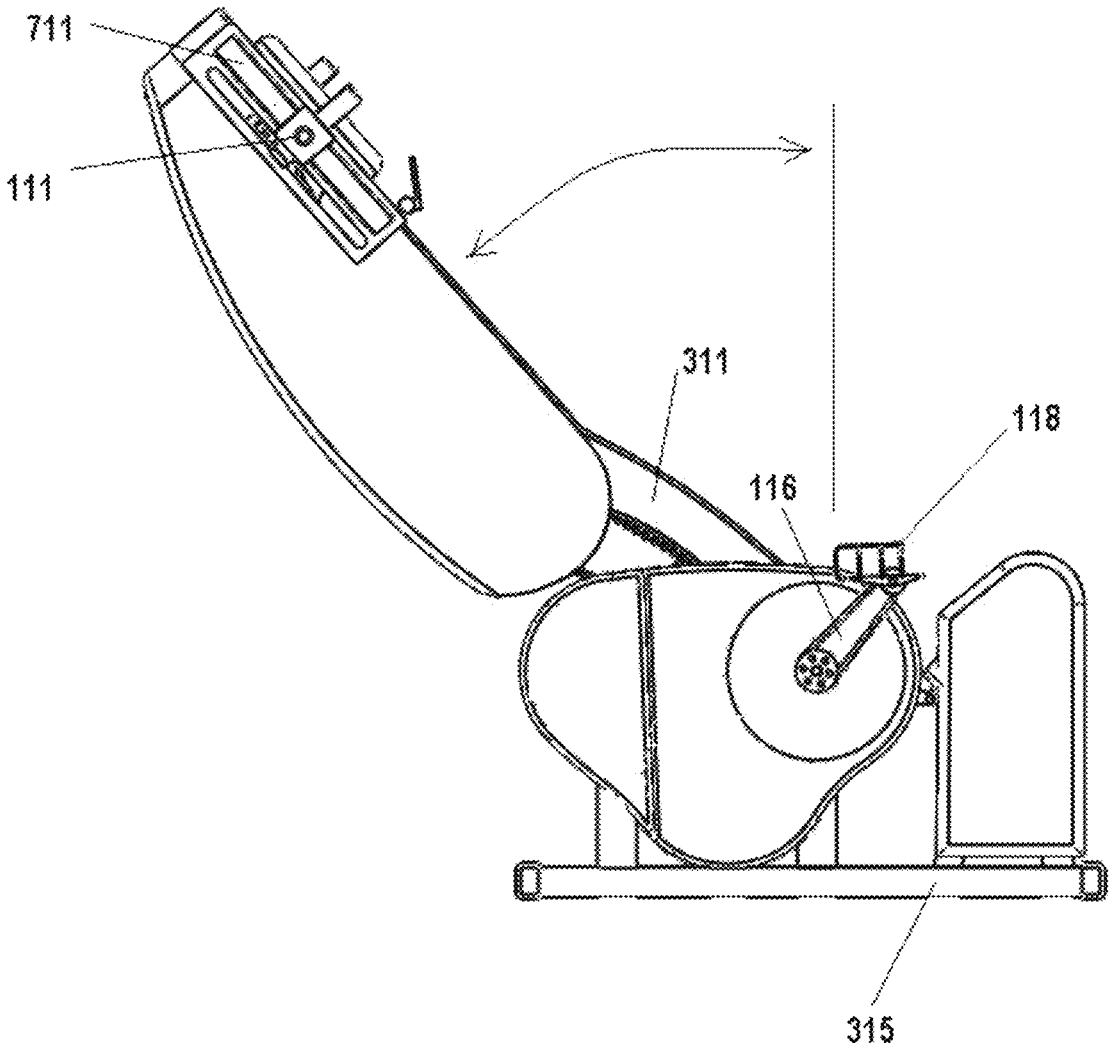
FIG. 2 is schematic side view of the described exercise apparatus when upstanding support is at the end of the tilt stroke with negative angle in relation to vertical line.
Figure 3:
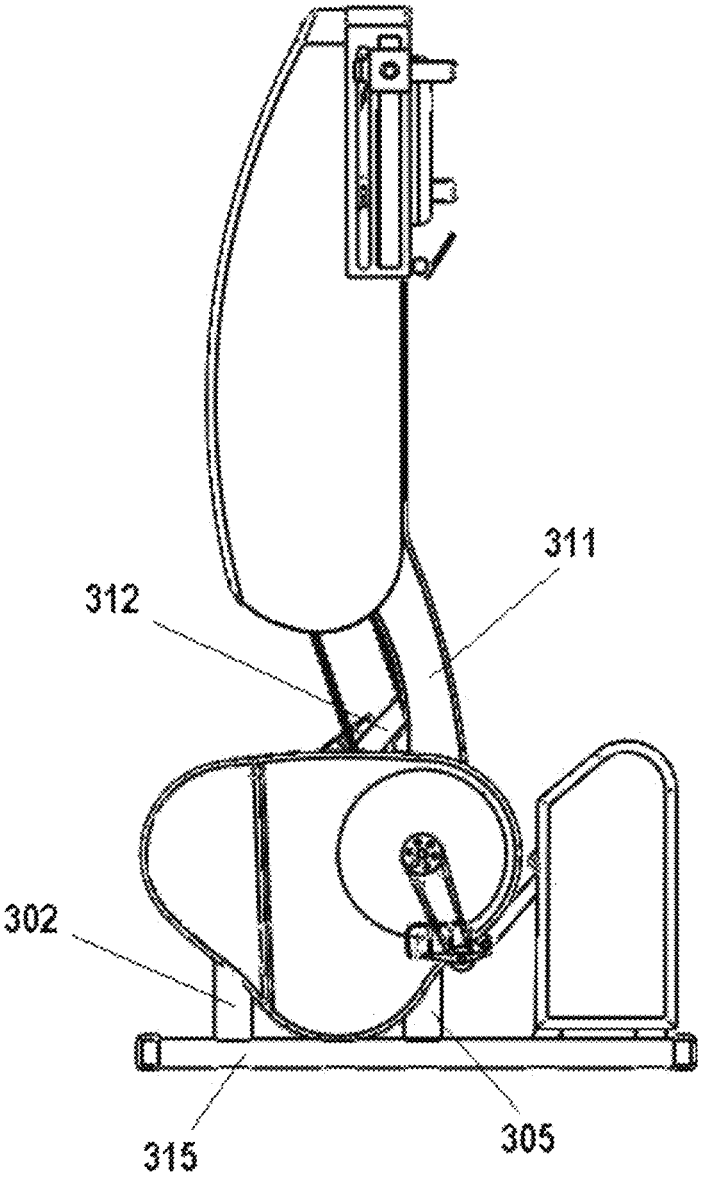
FIG. 3 is schematic side view of the described exercise apparatus when upstanding support is in a vertical position.
Figure 4:
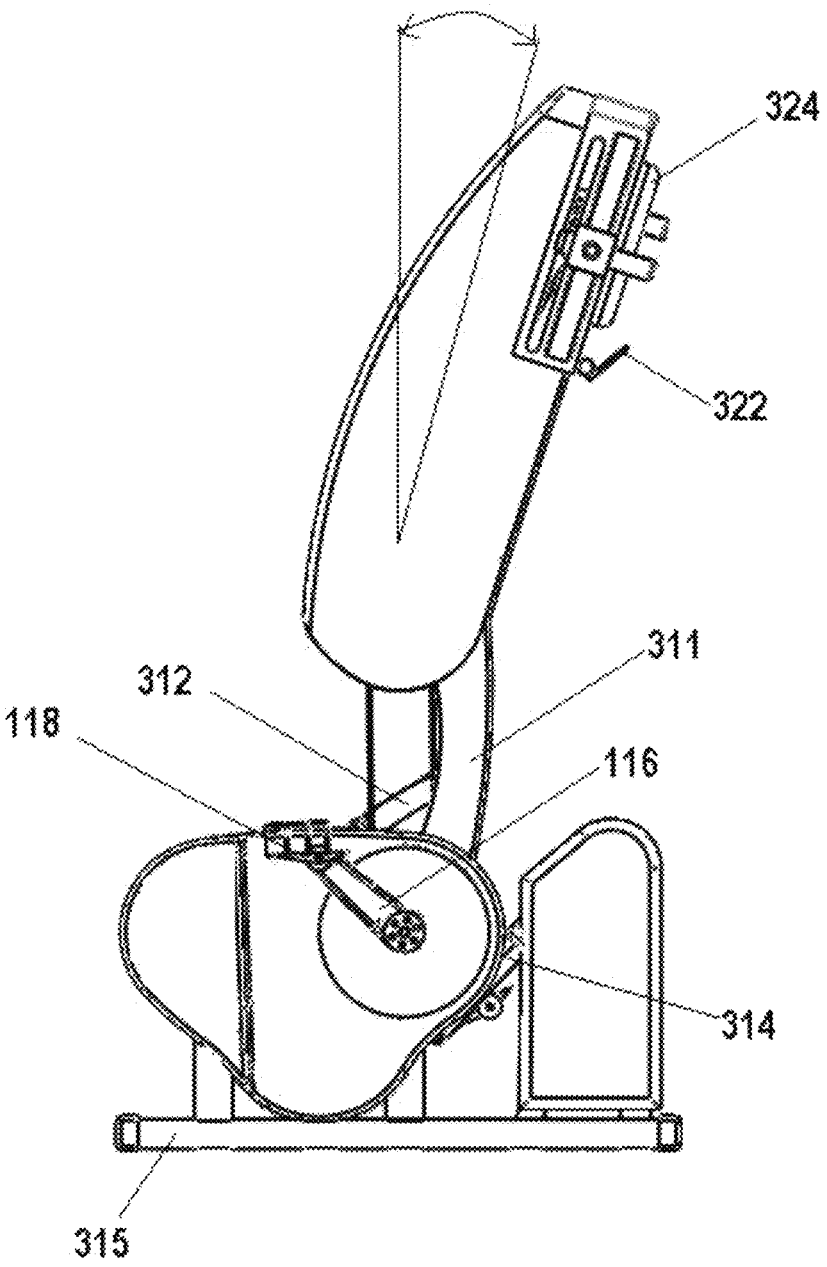
FIG. 4 is schematic side view of the described exercise apparatus when upstanding support is at the end of the tilt stroke with positive angle in relation to vertical line.
Figure 5:
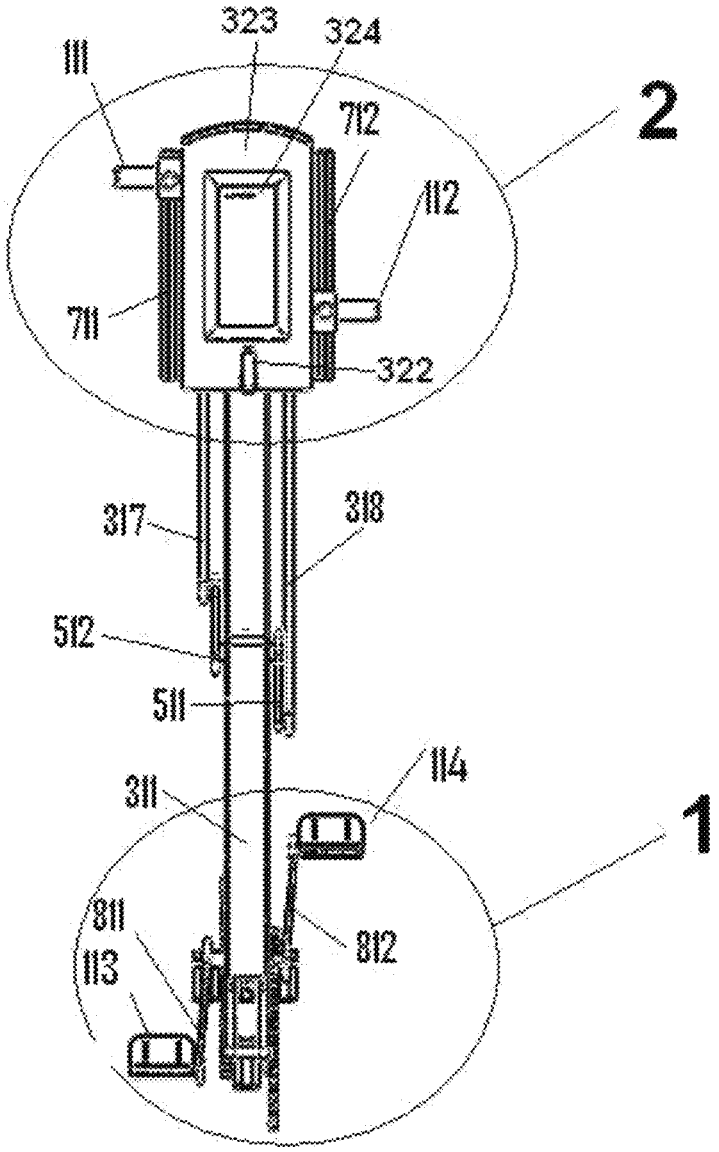
FIG. 5 is schematic front view of the described exercise apparatus shows pedaling unit and slid, unit also demonstrates grip members 111,112 move up and down in fully harmony with pedal members 113,114.
Figure 6:
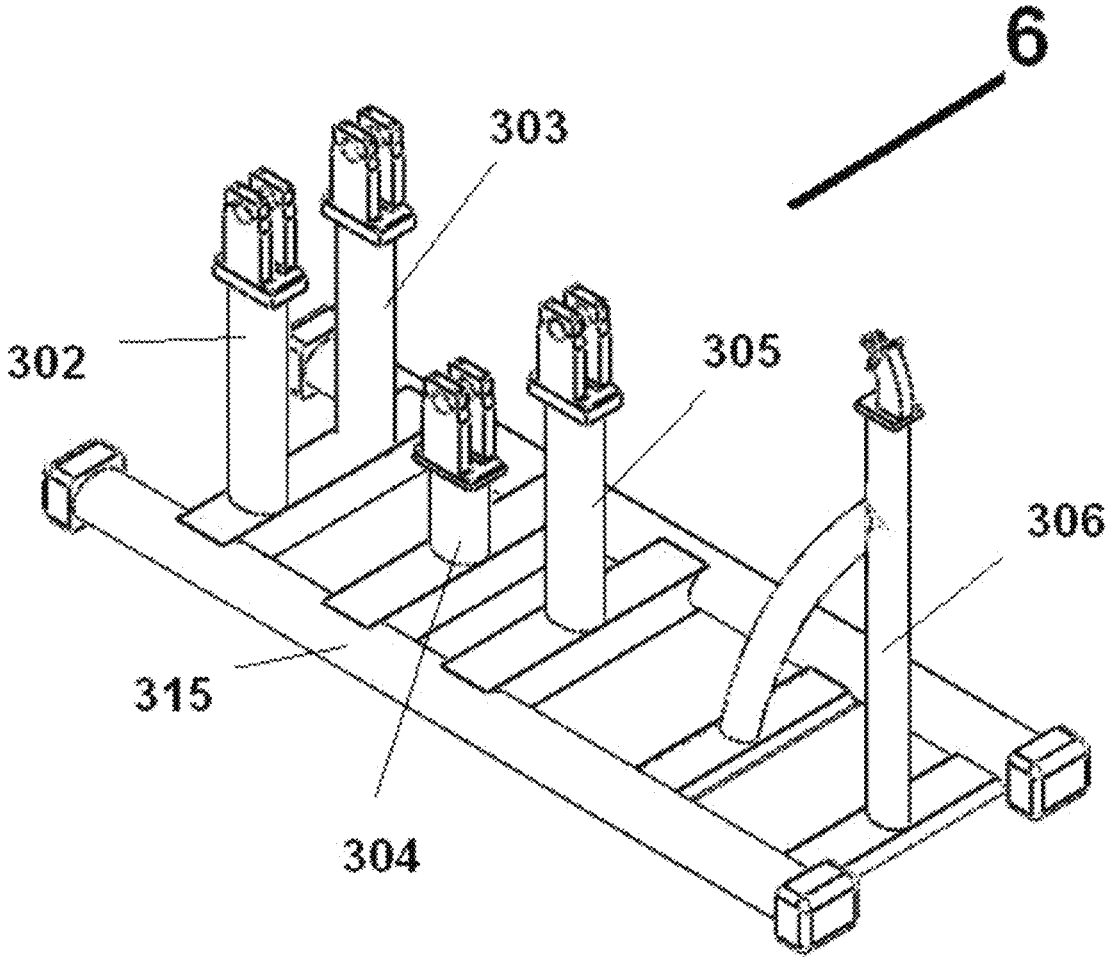
FIG. 6 is a perspective view of the main frame of described exercise apparatus and shows base support and pivot stands.
Figure 7:
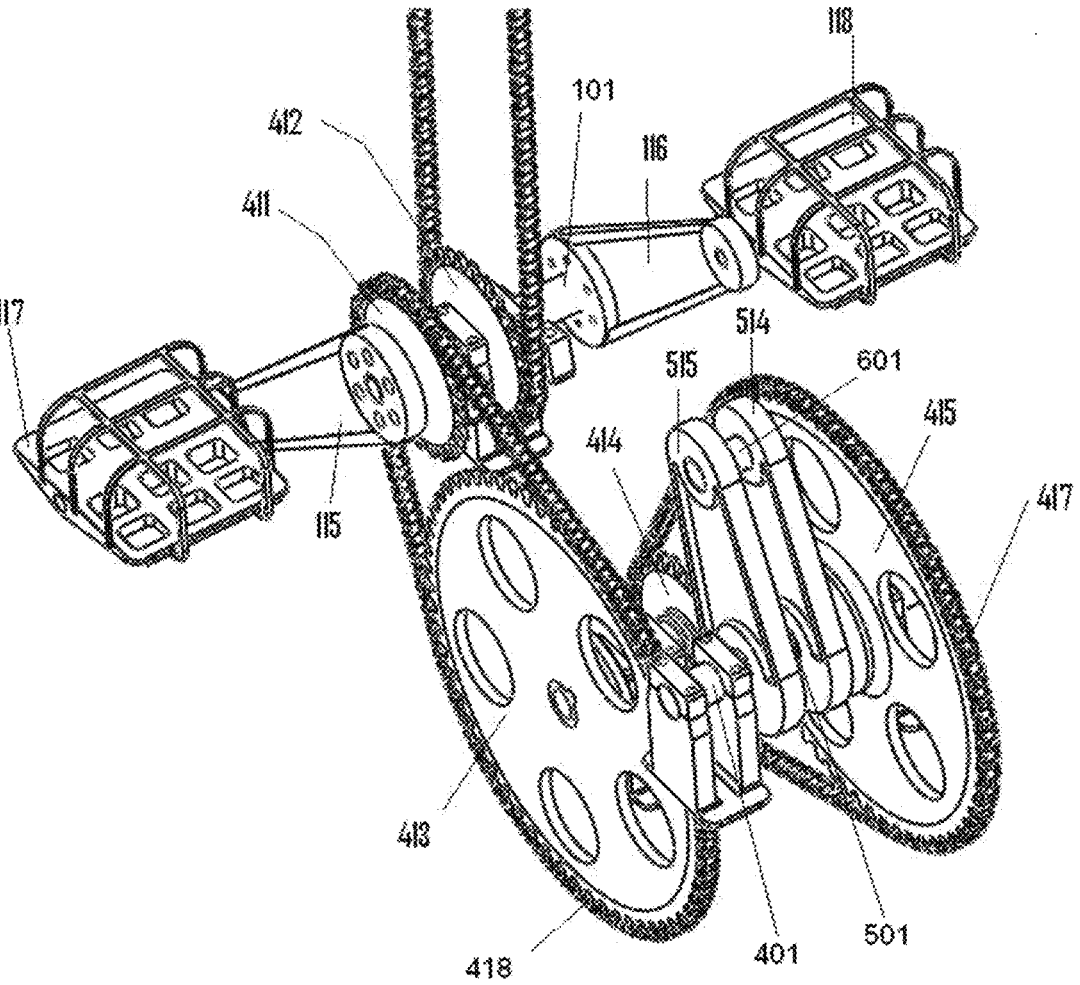
FIG. 7 is a perspective view of power transmission system and synchronizer.
Figure 8:
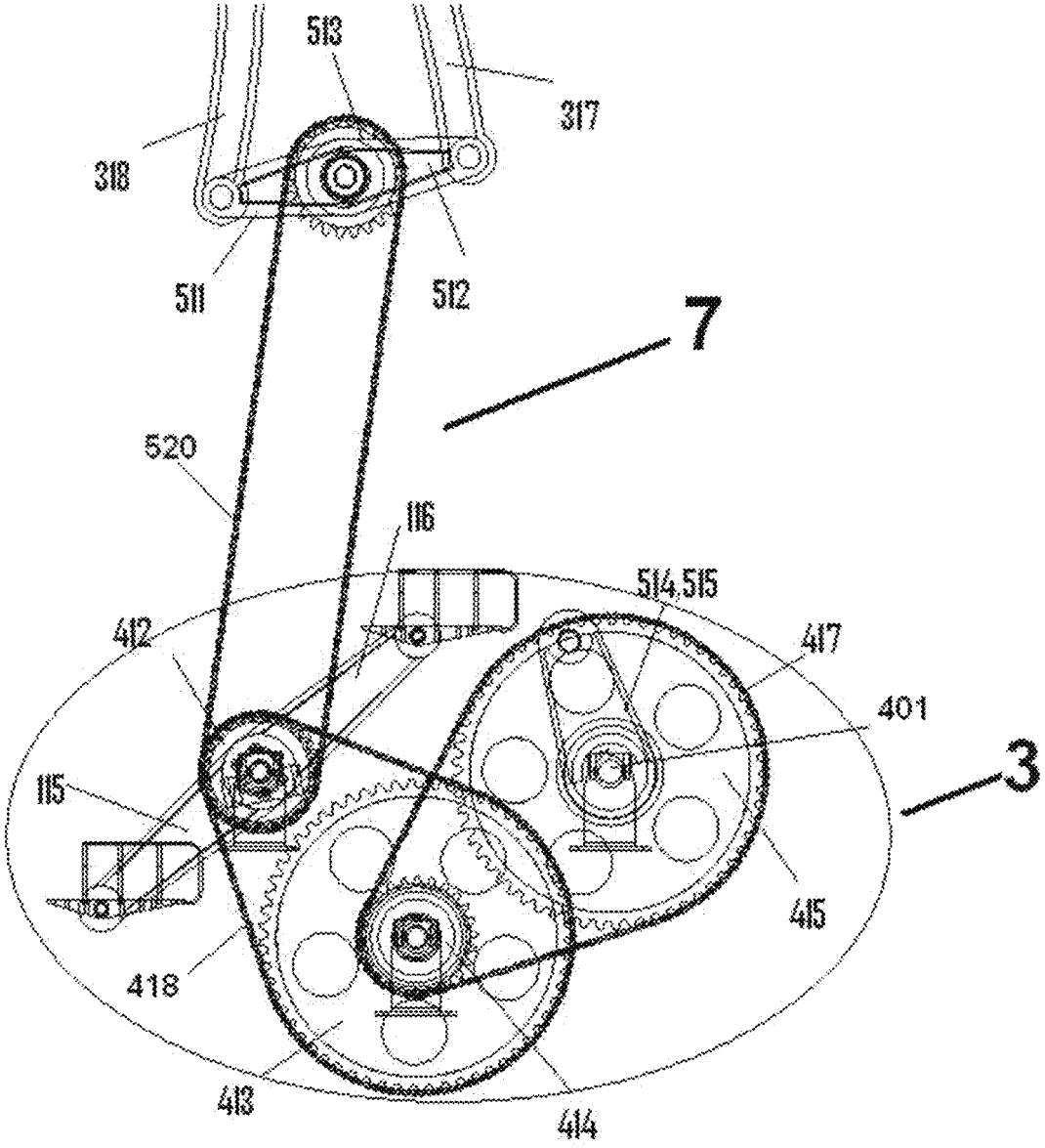
FIG. 8 is a schematic side view of power transmission system to transfer power from pedaling unit to tilt mechanism, and also synchronizer for the purpose of effecting harmonious movement between hands and feet.
Figure 9:
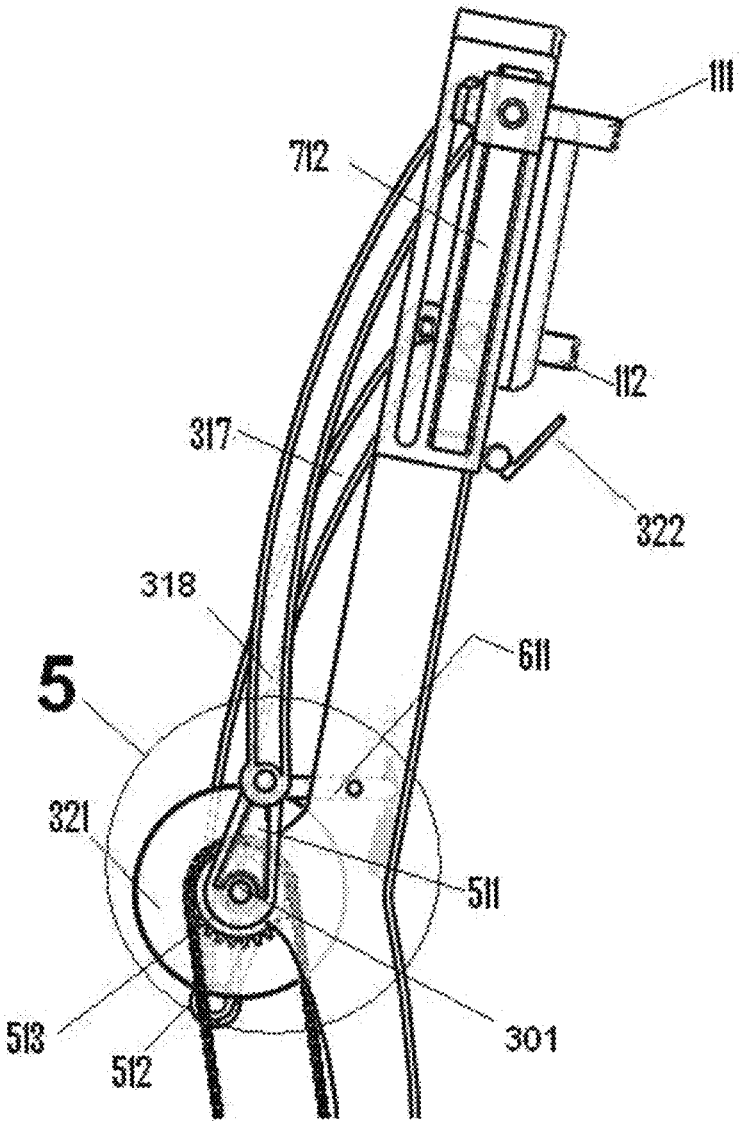
FIG. 9 is schematic side view of the described exercise apparatus shows crank-slider mechanism.
Figure 10:
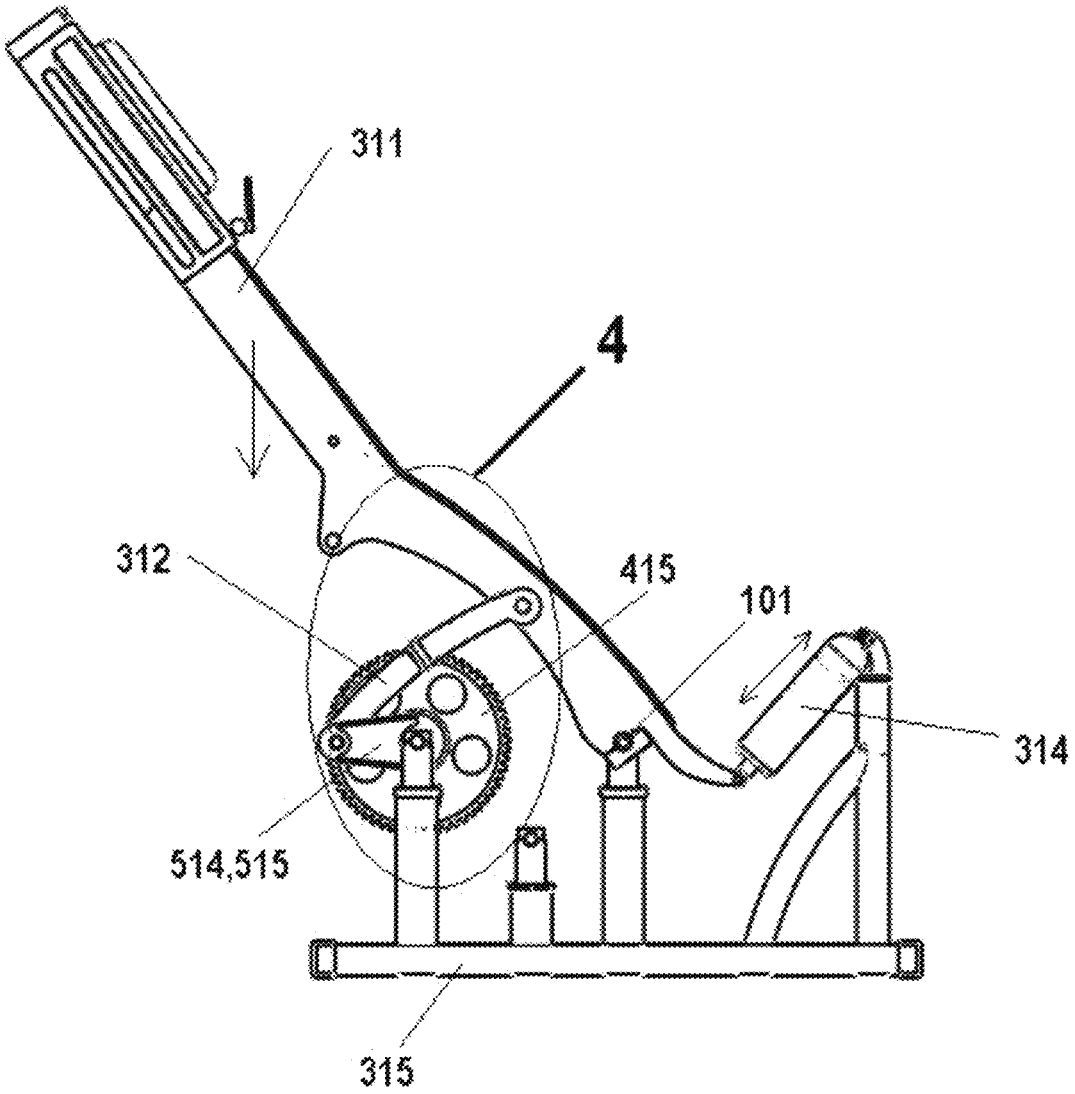
FIG. 10, 11 are schematic side views of the described exercise apparatus show tilt mechanism and tilt angle range of the upstanding support.
Figure 11:
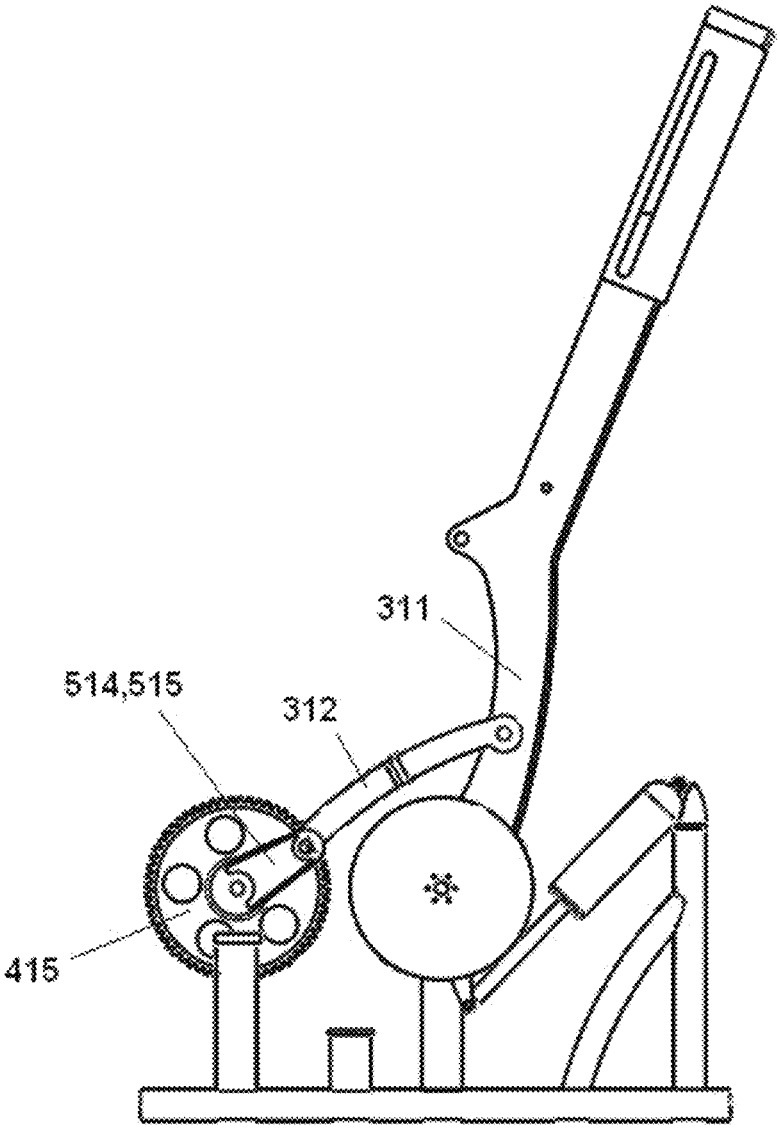
FIG. 11 shows the maximum tilt angle of upstanding support with positive angle in relation to the vertical line.
Figure 12:
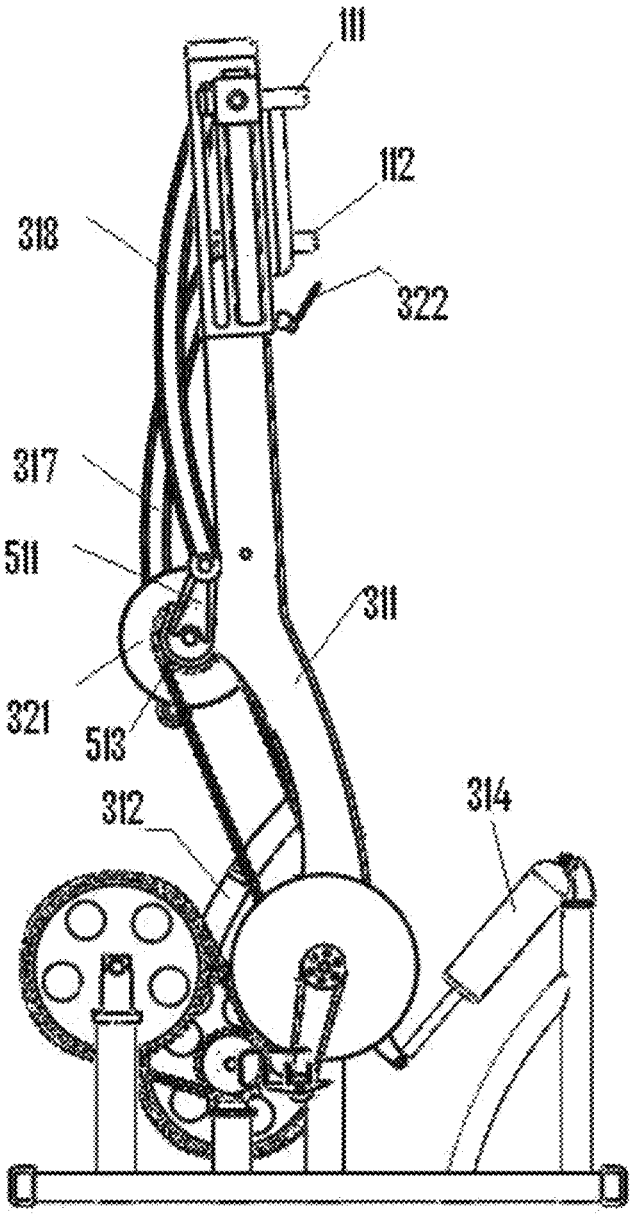
FIG. 12 shows general layout of the described exercise apparatuse.

Referring to FIGS. 1 to 12, the preferred embodiment of an exercise apparatus with oscillating tilt system according to present invention is shown to comprise a main frame 6, pedaling unit 1, slide unit 2, power transmission system 3, synchronizer 7, tilt mechanism 4, crank-slider mechanism 5, upstanding support 311, gas spring 314, resistance wheel 321, console 323, resistance control lever 322, computerized panel 324, friction pad/magnetic brake 611.

The main frame 6 which includes a base support 315 adapted to be mounted on a supporting surface, and at least 5 pivot stands 302,303,304,305,306 to support plurality of components. (See FIG. 6)

Pedaling unit 1 which includes main shaft 101 is rotatably connected to the pivot stand 305 (See FIGS. 6,7), and also crank arms 115,116 whose rear ends are fixed on the both ends of the main shaft 101, and pedals 117,118 pivotally connected to front ends of crank arms 117,118. (See FIG. 7)

Upstanding support 311 pivotally connected to the main shaft 101 of said pedaling unit 1. (See FIG. 10)

Crank-slider mechanism 5 which includes main shaft 301 rotatably connected to the middle section of the upstanding support 311, and crank links 511,512 whose rear ends are fixed on the both ends of the main shaft 301, and linkage arms 317,318 whose rear ends pivotally connected to the front ends of the crank links 511,512 and having front end pivotally connected to the slide unit 2, and resistance wheel 321 fixed on the main shaft 301. (See FIG. 9)

Slide unit 2 which includes linear rails 711,712 fixed laterally at the top end of the upstanding support 311, and sliders 111,112 whose bottoms slidably connected to rails 711,712 and having top ends pivotally connected to the front ends of the linkage arms 317,318. (See FIG. 5, 9)

Synchronizer 7 which includes sprocket/pulley 412 fixed on the main shaft 101 of said pedaling unit 1, and sprocket/pulley 513 fixed on the main shaft 301 of said crank-slider mechanism 5, and chain/belt 520 exchanges power between pedaling unit 1 and crank-slider mechanism 5 for the purpose of effecting movement between feet and hands. (See FIGS. 7, 8)

Console 323 fixed at the top end of the upstanding support 311, and resistance control lever 322 pivotally connected to the console 323, and friction pad/magnetic brake 611 pivotally connected to the middle section of the upstanding support 311; said lever 322 enabling the user to control friction pad/magnetic brake 611 for the purpose of controlling resisting force on the resistance wheel 321. (See FIG. 9)

Tilt mechanism 4 which includes main shaft 401 is rotatably connected to pivot stands 303, and main shaft 501 is rotatably connected to pivot stands 302, and crank arm 515 whose rear end fixed on the main shaft 401, and crank arm 514 whose rear end fixed on the main shaft 501, and shaft 601 fixed at the front ends of the crank arms 514,515, and linkage arm 312 whose rear end pivotally connected to shaft 601 and having front end pivotally connected to the middle section of the upstanding frame 311. (See FIGS. 7, 10)

Power transmission system 3 which includes sprocket/pulley 411 fixed on the main shaft 101, and also sprocket/pulley 415 fixed on the main shaft 501, also sprockets/pulleys 413,414 rotatably connected to the pivot stand 304, and chain/belt 418 transfers power from the sprocket/pulley 411 to sprocket/pulley 413 while decreases angular velocity and increases torque, and chain/belt 418 transfers power from the sprocket/pulley 414 to sprocket/pulley 415 while decreases angular velocity and increases torque. (See FIG. 7, 8)

Gas spring 314 whose front end pivotally connected to the bottom end of the upstanding support 311 and having rear end pivotally connected to the pivot stand 306 to balance forces on said upstanding support in various orientations in relation to the vertical line.

Furthermore, described exercise apparatus comprises a panel 324 mounted on the console 323. The panel 324 is a computerized device for the purpose of showing the parameters such as heart rate and calories burned of the user. Grip sections may include sensors (not shown) to detect the pulse rate of the user.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangement.

What is claimed is:

1. An exercise apparatus comprising:

a main frame;

a pedaling unit enabling a user to perform stand up pedaling action, said pedaling unit including a main shaft rotatably connected to a middle section of the main frame, said main shaft having two ends, and two crank arms, each of the two crank arms having a rear end fixed at respective end of the two ends of said main shaft, and two pedals, each of the two pedals pivotally connected to a front end of respective one of said two crank arms;

an upstanding support, a middle section of said upstanding support pivotally connected to said main shaft of the pedaling unit, said upstanding support changing an orientation of the user in relation to a vertical line during a workout;

a crank-slider mechanism positioned at a top end of said upstanding support enabling the user to move the hands up and down linearly;

a tilt mechanism tilting said upstanding support and changing said orientation of said user in relation to the vertical line, said tilt mechanism comprising a tilt mechanism crank arm having a rear end rotatably connected to a front end of the main frame, said tilt mechanism crank arm has a front end operatively associated with the upstanding support such that rotating of the tilt mechanism crank arm causes an oscillating motion of the upstanding support;

a power transmission system to transfer power produced by the user from said pedaling unit to said tilt mechanism, said power produced by the user enabling said tilt mechanism tilting said upstanding support;

a synchronizer exchanging power produced by the user between said pedaling unit and said crank-slider mechanism, said synchronizer is configured to synchronize said pedaling unit with crank-slider mechanism and effecting harmonious motion between said feet and hands of said user;

a gas spring comprising a front end pivotally connected to a bottom end of said upstanding support and having a rear end pivotally connected to a rear end of said main frame to balance forces affecting said upstanding support while changing said orientation of said user in relation to the vertical line;

a controlling means including a computerized panel showing heart rate and burned calories of the user, a resistance wheel, and a friction pad/magnetic brake adjusting resistance force on the resistance wheel, wherein adjusting said resistance force determines the effort required of the user.

2. The exercise apparatus of claim 1, wherein said crank-slider mechanism further includes a slide unit positioned at the top end of the upstanding support, two crank links, each of the two crank links including a rear end and a front end, the rear end of each of the two said crank links rotatably connected to an upper end of the middle section of said upstanding support, and two linkage arms, each of the two linkage arms having a rear end and a front end, said rear end of each of the two linkage arms pivotally connected to said front end of respective one of said two crank links, and each said front end of each of the two linkage arms pivotally connected to the slide unit.

3. The exercise apparatus of claim 2, wherein said slide unit further includes two rails fixed laterally at the top end of said upstanding support, and two sliders, each of the two sliders having a bottom and a top, said bottom of each of the two sliders slidably connected to a respective one of said two rails, and each of said two sliders having said top pivotally connected to the front ends of each respective one of said two linkage arms.

4. The exercise apparatus of claim 1, wherein said tilt mechanism further includes at least one tilt mechanism linkage arm, said at least one tilt mechanism linkage arm is configured to connect said front end of said tilt mechanism crank arm to the middle section of said upstanding support so that said upstanding support has oscillating motion.

5. The exercise apparatus of claim 1 enabling the user to perform stand up pedaling action.

6. The exercise apparatus of claim 1 enabling the user to move hands up and down linearly while performing stand up pedaling.

7. The exercise apparatus of claim 1 changing the orientation of the user in relation to a vertical line during an exercise.

* * * * *